US009476564B2

(12) United States Patent
Lai

(10) Patent No.: US 9,476,564 B2
(45) Date of Patent: Oct. 25, 2016

(54) LED AUTOMOBILE HEADLAMP

(75) Inventor: Yisong Lai, Guangdong (CN)

(73) Assignee: SHENZHEN YIKE ELECTROOPTICAL TECHNOLOGY CO., LTD., Guangdong (CN)

( * ) Notice: Subject to any disclaimer, the term of this patent is extended or adjusted under 35 U.S.C. 154(b) by 16 days.

(21) Appl. No.: 14/416,918

(22) PCT Filed: Jul. 25, 2012

(86) PCT No.: PCT/CN2012/079143

§ 371 (c)(1),
(2), (4) Date: Jun. 26, 2015

(87) PCT Pub. No.: WO2014/015484

PCT Pub. Date: Jan. 30, 2014

(65) Prior Publication Data

US 2015/0354776 A1 Dec. 10, 2015

(51) Int. Cl.

*F21V 29/51* (2015.01)
*F21S 8/10* (2006.01)
*F21Y 101/02* (2006.01)

(52) U.S. Cl.

CPC ..... *F21S 48/326* (2013.01); *F21S 48/115* (2013.01); *F21S 48/1109* (2013.01); *F21S 48/1113* (2013.01); *F21S 48/1159* (2013.01);
(Continued)

(58) Field of Classification Search

CPC ..... F21S 48/32; F21S 48/326; F21S 48/115; F21S 48/325; F21S 48/328; F21V 29/006; F21V 29/51

See application file for complete search history.

(56) References Cited

U.S. PATENT DOCUMENTS 6,773,138 B2 * 8/2004 Coushaine ..... F21S 48/1113 362/294
7,914,184 B2 * 3/2011 Liu ..... F21V 29/004 362/157

(Continued)

FOREIGN PATENT DOCUMENTS

CN 101202317 A 6/2008
CN 101487586 A 7/2009

(Continued)

OTHER PUBLICATIONS

International Search Report dated Apr. 18, 2013.

*Primary Examiner* — Julie Bannan
(74) *Attorney, Agent, or Firm* — Polsinelli PC

(57) ABSTRACT

An LED automobile headlamp includes an LED lamp positioned on a substrate (100); a heat conducting member (200) having a strip shape, with the substrate (100) being fixed to an end of the heat conducting member (200), and the heat conducting member (200) being internally filled with a low-boiling liquid; and a heat dissipating member (300), including a heat dissipating cylinder (320) and a plurality of heat dissipating fins (340), wherein the heat dissipating cylinder (320) defines a through hole to receive the heat conducting member (200), and the plurality of heat dissipating fins (340) are fixed to a periphery of an end of the heat dissipating cylinder (320) away from the substrate. The LED automobile headlamp uses an LED lamp instead of the traditional tungsten filament and HID, and transmits the heat generated by the LED lamp to the rear end by means of the circulation of the low-boiling liquid in the heat conducting member (200), and then uses the heat dissipating member (300) to dissipate heat.

13 Claims, 14 Drawing Sheets

(52) U.S. Cl.
CPC ..... *F21S48/325* (2013.01); *F21S 48/328* (2013.01); *F21S 48/33* (2013.01); *F21V 29/51* (2015.01); *F21Y 2101/02* (2013.01)

(56) References Cited

U.S. PATENT DOCUMENTS 8,040,674 B2 * 10/2011 Chen ..... F04D 25/0613 165/185
2004/0213016 A1 10/2004 Rice
2006/0001384 A1 * 1/2006 Tain ..... F21K 9/00 315/246
2007/0076431 A1 * 4/2007 Atarashi ..... G02B 6/0085 362/613
2007/0253202 A1 * 11/2007 Wu ..... F21V 29/006 362/294
2008/0093962 A1 * 4/2008 Kim ..... F28D 15/02 313/46
2008/0144319 A1 * 6/2008 Chang ..... B82Y 10/00 362/294
2009/0046469 A1 * 2/2009 Yang ..... F21V 29/76 362/310
2010/0117534 A1 * 5/2010 Chen ..... F21K 9/00 315/32
2010/0207502 A1 * 8/2010 Cao ..... F21K 9/135 313/46
2010/0309671 A1 * 12/2010 Meyer, IV ..... F21K 9/00 362/373
2013/0010479 A1 * 1/2013 Chen ..... F21K 9/13 362/373

FOREIGN PATENT DOCUMENTS

CN 101900313 A 12/2010
CN 102200263 A 9/2011
JP 2004206947 A 7/2004
JP 2007048727 A 2/2007

* cited by examiner

LED AUTOMOBILE HEADLAMP

CROSS-REFERENCE TO RELATED APPLICATIONS

This application is a National Phase filing under 35 U.S.C. §371 of PCT/CN2012/079143 filed on Jul. 25, 2012 the entire contents of which is hereby incorporated by reference.

FIELD OF THE INVENTION

The present disclosure relates to a field of lighting equipment, and more particularly relates to an LED automobile headlamp.

BACKGROUND OF THE INVENTION

A conventional automobile headlamp usually emits light by using a vacuum tungsten filament bulb or a xenon high intensity discharge (X-HID) lamp, or by using multiple single LED lighting modules. The modules are packaged and located on different heat dissipating structures, and then assembled to a lamp holder of the automobile headlamp. On the other head, gaps between the light source modules and the heat dissipating structures are filled with heat conductive silver glue or smeared thermal grease. In above two cases, there is a certain thermal resistance between the light source modules and the heat dissipating structures, thus causing a relatively great temperature difference between the light source modules and the heat dissipating structures, which is unable to completely solve the heat conductive problem. Accordingly, the above shortcomings may cause a failure of the LED to reach a higher power, and thus the luminance and the electro-optical conversion rate of the LED are low.

SUMMARY OF THE INVENTION

Accordingly, in order to address the problems of low-power and bad heat dissipation of the LED, it is necessary to provide an LED automobile headlamp with good heat dissipation and is capable to assemble a high-power LED.

An LED automobile headlamp includes:

an LED lamp positioned on a substrate;

a heat conducting member having a strip shape, with the substrate being fixed to an end of the heat conducting member, and the heat conducting member being internally filled with a low-boiling liquid; and a heat dissipating member, including a heat dissipating cylinder and a plurality of heat dissipating fins, the heat dissipating cylinder defines a through hole to receive the heat conducting member, and the plurality of heat dissipating fins are fixed to a periphery of an end of the heat dissipating cylinder away form the substrate.

In one embodiment, the LED automobile headlamp further includes an retaining member sleeved on the heat dissipating cylinder configured to secure the heat dissipating member provided with the LED lamp to a lamp holder of a automobile headlamp assembly.

In one embodiment, the retaining member includes a connecting portion having a cylindrical shape and a bayonet, the connecting portion is sleeved on the heat dissipating cylinder, and the bayonet is radially protrudes from an outer sidewall of the connecting portion, the bayonet is configured to be latched with the lamp holder of the automobile headlamp assembly of a corresponding lamp type, and a distance between the bayonet and a luminous point of the LED lamp meets the focal distance standard of automobile lamps.

In one embodiment, the heat conducting member includes a heat conductive platform and a heat conductive pipe, the substrate is fixed to an end surface or a side surface of an end of the heat conductive platform, the other end or an inner hole of the heat conductive platform is connected to the heat conductive pipe, and the heat conductive pipe is received in the through hole.

In one embodiment, the LED automobile headlamp further includes a waterproof member, the waterproof member is received in a groove defined on the retaining member, and the waterproof member is positioned on one side of the bayonet facing the LED lamp.

In one embodiment, the LED automobile headlamp further includes a control module and a temperature sensor, the temperature sensor is positioned on the substrate and is configured to sense a temperature of the LED lamp; the heat dissipating member further includes a fan in contact with the plurality of heat dissipating fins and is opposite to the heat conducting member; the control module controls the fan to work in accordance with the temperature.

In one embodiment, the plurality of heat dissipating fins define a receiving groove on a side thereof coaxial with the heat conducting member and away from the substrate to receive the fan.

In one embodiment, the heat conducting member is provided with capillaries on an inner sidewall thereof.

In an embodiment, the heat dissipating cylinder comprises a first segment and a second segment latch with each other, the retaining member is sleeved on an end of the second segment adjacent to the first segment, and the heat dissipating fins are positioned on an end of the second segment away from the first segment.

In an embodiment, the first segment is threadedly connected to the second segment through a sleeve.

The LED automobile headlamp described above applies an LED lamp instead of a tungsten filament lamp bulb or a high intensity discharge applied in the conventional automobile headlamp, thus enhancing the luminance and the electro-optical conversion rate of the automobile headlamp, and reducing energy consumption. Besides, by means of the circulation of the low-boiling liquid received in the heat conducting member to transmit the heat provided by the LED lamp to the heat dissipating member, the heat dissipating speed is accelerated. Since the heat dissipating function is improved, a relatively high-power LED can be applied to improve performance.

Moreover, by positioning the substrate provided with the LED lamp on an end surface or a side surface of an end of the heat conductive platform, the LED lamp can performs a variety of arrangements and distributions, so as to implement designs of different luminance and angles, which are respectively applied to different types of headlamp assemblies.

DETAILED DESCRIPTION OF THE EMBODIMENTS

Figure 1:
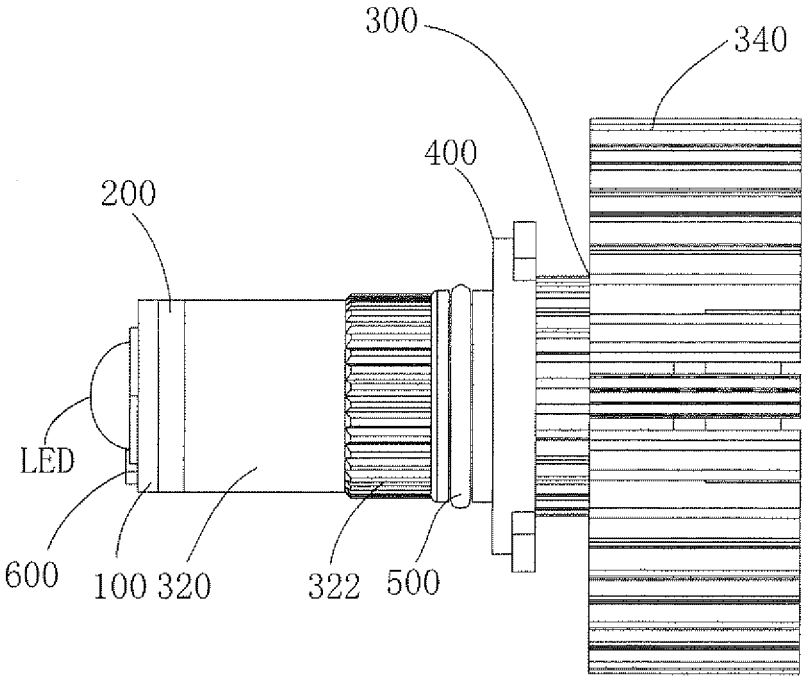
FIG. 1 is a side view of an LED automobile headlamp in accordance with an embodiment.

Referring to FIG. 1, FIG. 1 shows an LED automobile headlamp in accordance with an embodiment. The LED automobile headlamp includes an LED lamp, a substrate 100, a heat conducting member 200, a heat dissipating member 300 and an retaining member 400.

The LED lamp is positioned on the substrate 100, the substrate 100 is a printed circuit board (PCB). In the illustrated embodiment, the LED lamp may be single or plural. In the case of multiple LED lamps, the LED lamps are respectively positioned on multiple substrates 100; also, the LED lamps may be positioned on the same substrate 100. The multiple LED lamps can enhance the luminance of the LED automobile headlamp.

The heat conducting member 200 is in a strip shape, i.e. long strip shape of cylinder, cuboid, or polyhedron. The substrate 100 is fixed to an end of the heat conducting member 200, when the LED automobile headlamp works, the LED lamp on the substrate 100 releases heat, and the heat conducting member 200 will transmit all the heat from the end provided with the substrate 100 to the other end.

In a preferable embodiment, the heat conducting member 200 includes a heat conductive platform 220 and a heat conductive pipe 240. The substrate 100 is fixed to an end surface or a side surface of an end of the heat conductive platform 220, while the other end or an inner hole of the heat conductive platform 220 is connected to the heat conductive pipe 240. Specifically, the heat conductive platform 220 and the heat conductive pipe 240 may be integrally formed, or be connected to each other by welding the ends thereof, or, an end of the heat conductive pipe 240 may also be received in a hole (the inner hole mentioned above) defined at an end of the heat conductive platform 220 opposite to the heat conductive pipe 240, and the end of the heat conductive pipe 240 is fixed to the heat conductive platform 220. Such arrangement can provide a variety of distributions of the LED lamp on the premise of meeting the focal distance standard of automobile headlamps, for example, if the substrate 100 is positioned on the end surface of the heat conducting member 200, the single LED lamp or the multiple LED lamps can be flatly and evenly distributed. Referring to FIG. 7, FIG. 11, FIG. 12, and FIG. 13, when the substrate 100 is positioned on the side surface of the heat conducting member 200, a side surface provided with the heat conducting member 200 or the multiple LED lamps can be distributed circlewise, symmetrically or asymmetrically (referring to FIG. 8), or dislocation distributed (referring to FIG. 8), so as to implement a high-low lamp, a high beam or a dipped headlamp of the LED automobile headlamp.

Figure 2:
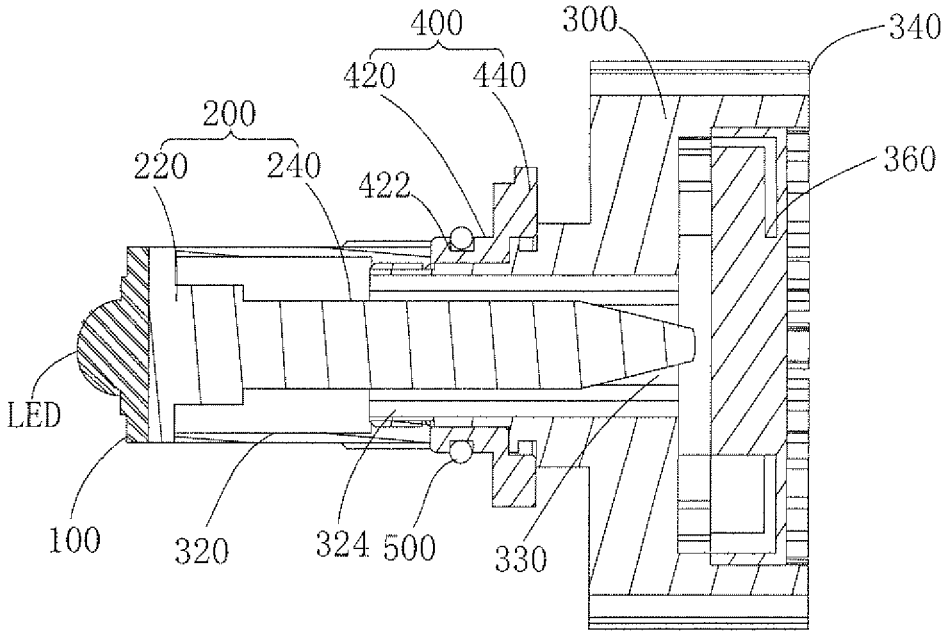
FIG. 2 is a cross-sectional view of the LED automobile headlamp of FIG. 1.
Figure 3:
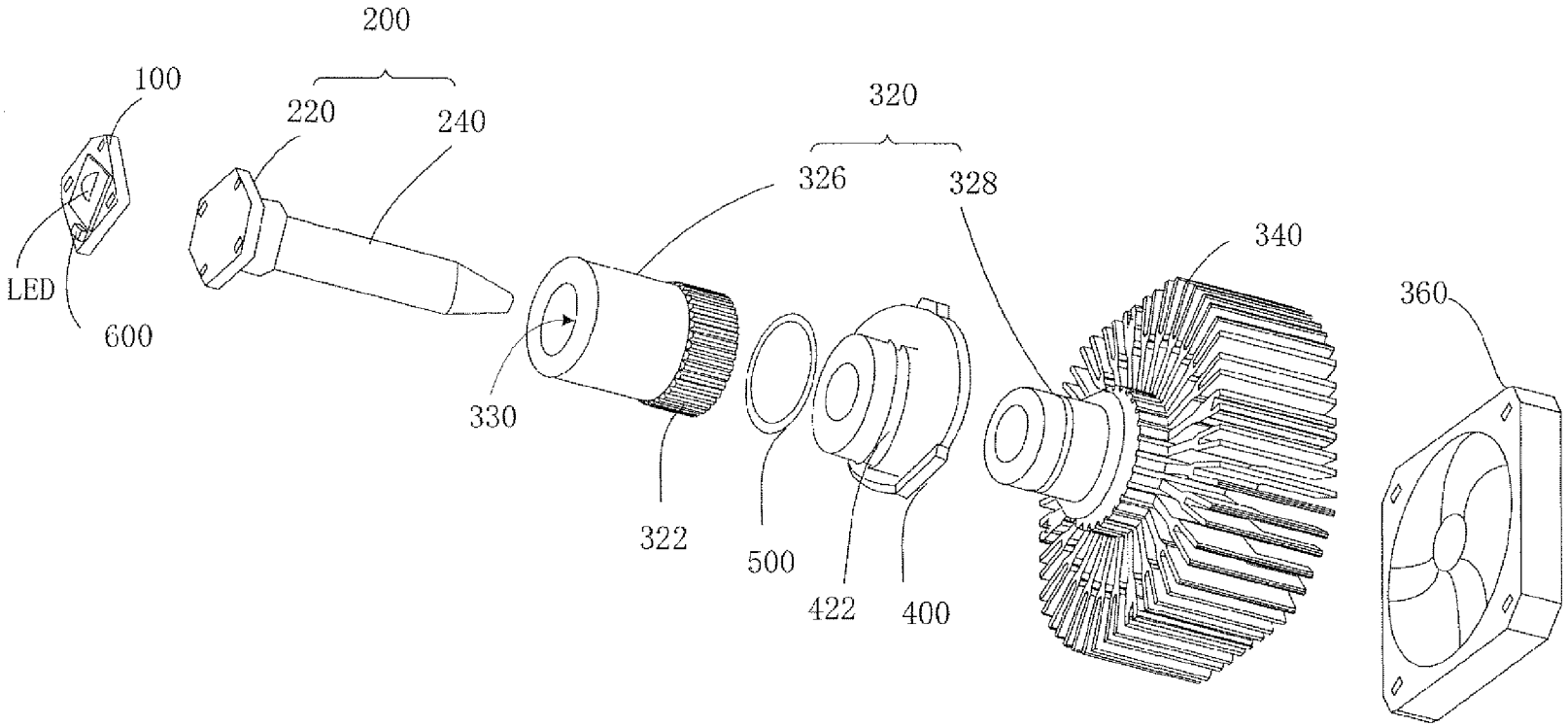
FIG. 3 is an exploded view of the LED automobile headlamp of FIG. 1.
Figure 5:
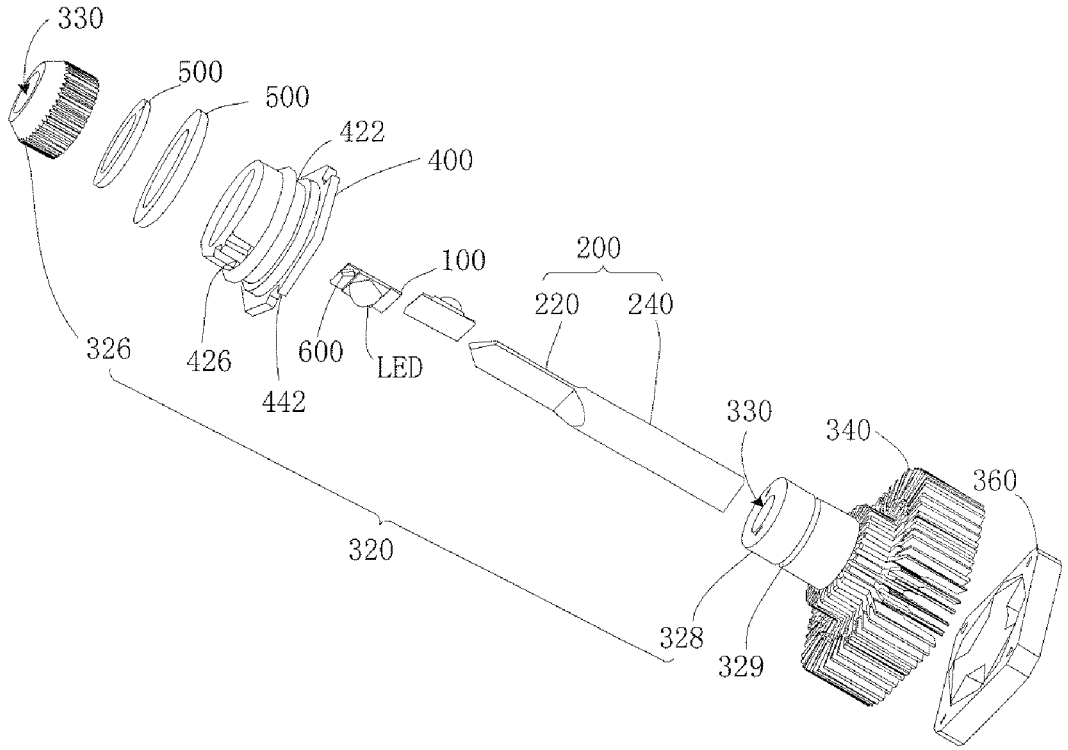
FIG. 5 is an exploded view of an LED automobile headlamp in accordance with another embodiment.
Figure 6:
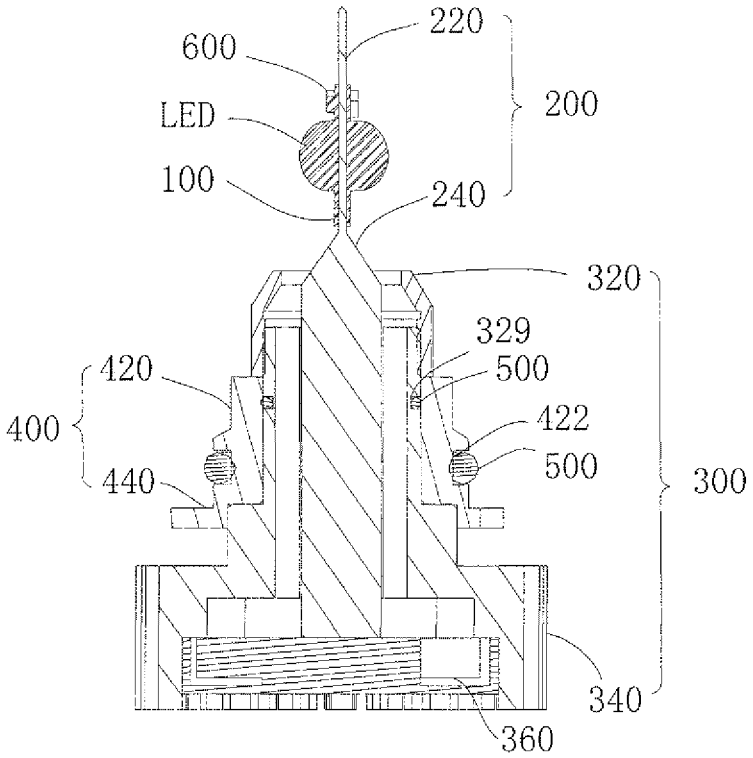
FIG. 6 is a cross-sectional view of the LED automobile headlamp of FIG. 5.
Figure 7:
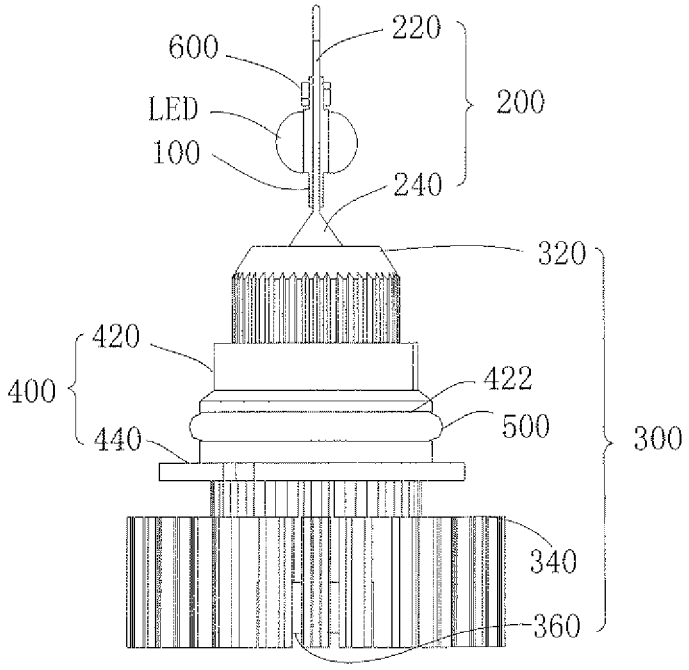
FIG. 7 is a front view of the LED automobile headlamp of FIG. 5.
Figure 8:
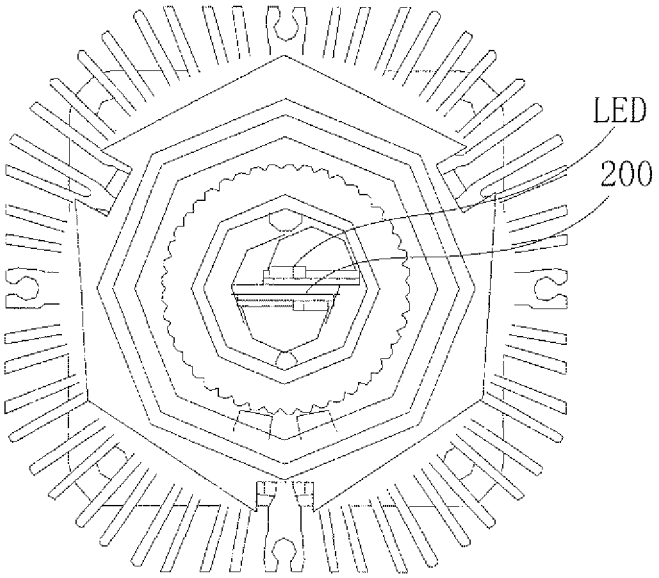
FIG. 8 is a top view of the LED automobile headlamp of FIG. 5.
Figure 9:
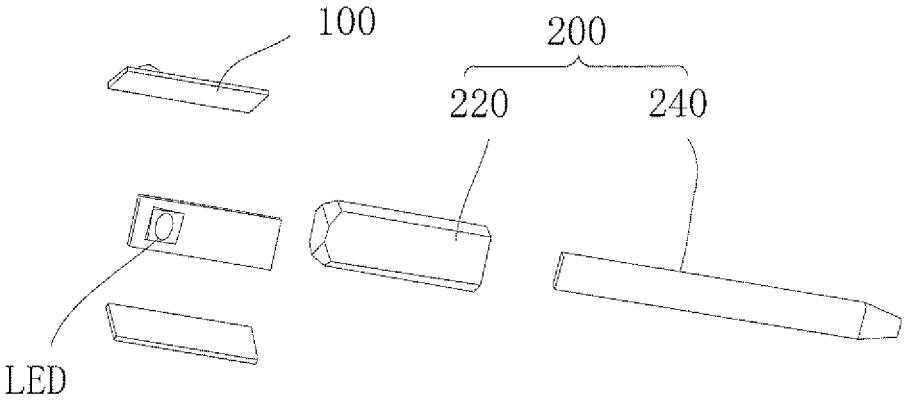
FIG. 9 is an exploded schematic view of a heat conducting member in accordance with another embodiment.
Figure 10:
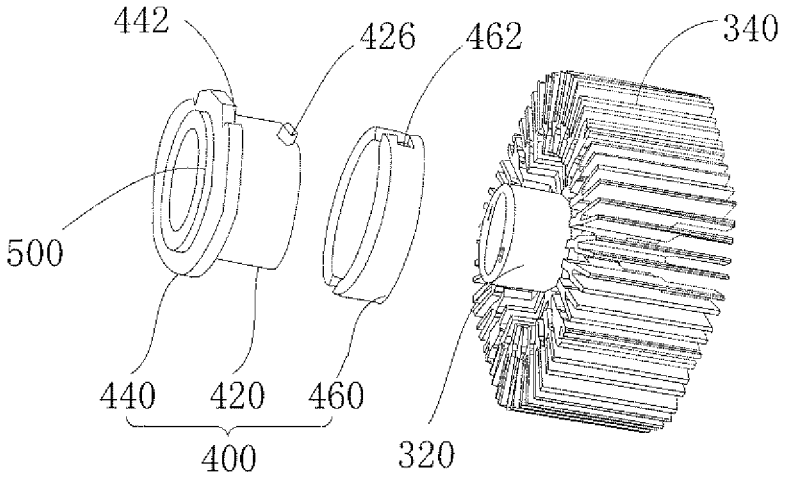
FIG. 10 is an exploded schematic view of an retaining member in accordance with another embodiment.
Figure 11:
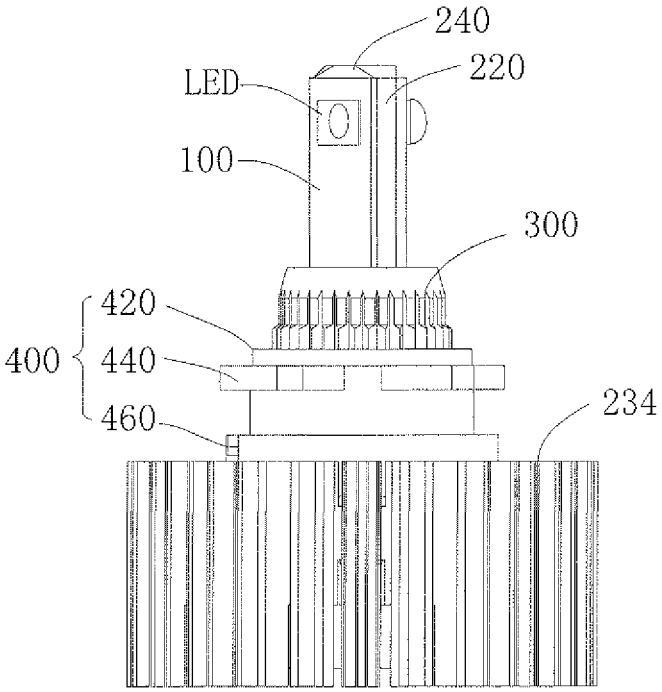
FIG. 11 is a front view of the LED automobile headlamp using the heat conducting member of FIG. 9 and the retaining member of FIG. 9.

Referring to FIG. 2 and FIG. 3, the heat conductive platform 220 may be in a "T" shape, while the substrate 100 is fixed to a top of the "T"; referring to FIG. 5, FIG. 6 and FIG. 7, the heat conductive platform 220 may also be a flat cuboid, while the substrate 100 is fixed to opposite sides of the cuboid, so that the LED lamps are symmetrically or asymmetrically distributed relative to the cuboid (referring to FIG. 8); referring to FIG. 9, FIG. 10 and FIG. 11, the heat conductive platform 220 may also be a polyhedron having a strip shape, the substrate 100 can be positioned on one surface of the polyhedron or several substrates 100 are positioned on every one surface of the polyhedron, so that the LED lamps are circlewise distributed relative to the polyhedron.

Referring to FIG. 2, the heat conducting member 200 is filled with a low-boiling liquid, specifically, the low-boiling liquid is filled in the heat conductive pipe 240, certainly, the heat conductive platform 220 may also be filled with the low-boiling liquid therein, and preferably, the low-boiling liquid is water vapors. The heat conducting member 200 is evacuated to a state of negative pressure and filled with appropriate low-boiling liquid therein, which is easy to volatilize. Preferably, a plurality of capillaries (capillary wicks) are positioned on an inner sidewall of the heat conducting member 200, and the capillaries consist of capillary porous materials. The end of the heat conducting member 200 adjacent to the substrate 100 is an evaporation end, while the other end is a condensation end, and when the evaporation end of the heat conducting member 200 is heated, the heat is transmitted from the evaporation end to the condensation end of the heat conducting member 200. Specifically, the liquid in the capillaries is rapidly evaporated, the vaporized low-boiling liquid flows to the condensation end under a slight pressure difference, and releases heat, and then is recondensed into liquid; the liquid flows back to the evaporation end along the porous materials under the capillary force, circulates without stopping, so as to transmit the heat from the evaporation end to the condensation end of the heat conducting member 200. Such circulation is rapidly performed, thus the heat can be transmitted continuously.

The heat dissipating member 300 includes a heat dissipating cylinder 320 and a plurality of heat dissipating fins 340, the heat dissipating cylinder 320 is provided with a through hole 330 for receiving the heat conducting member 200, specifically, the heat conductive pipe 240 of the heat conducting member 200 is received in the through hole 330, and the heat conductive pipe 240 is fixed to the through hole 330 by placing a leaf spring between the outer surface of the heat conductive pipe 240 and the inner surface of the through hole 330, or using a screw, screw thread or a clamping piece. The plurality of heat dissipating fins 340 are fixed to a periphery of an end of the heat dissipating cylinder 320 away form the substrate 100. In the illustrated embodiment, the outer sidewall of the heat dissipating cylinder 320 is provided with antiskid thread, the antiskid thread is configured to increase the torque force during assembling the heat dissipating member 300, so that the structure of the heat dissipating member 300 is reliable.

Furthermore, two bypasses 324 are positioned on both sides of the through hole 330, the bypasses 324 are configured to receive wires for supplying power or providing control signals to the LED lamp, besides, the bypasses 324 can implement partly air isolation of the through hole 330 configuring the heat conducting member 200, ensuring the heat conducting member 200 to transmit more heat to the direction of the heat dissipating fins 340 rather than the both sides, which improves the heat dissipating efficiency.

Referring to FIG. 3 and FIG. 5, the heat dissipating cylinder 320 includes a first segment 326 and a second segment 328 sleeved with each other. The first segment 326 and the second segment 328 are threaded connected through a sleeve 322, and the prior antiskid thread is defined on the outer sidewall of the sleeve 322, while the heat dissipating fins 340 are defined at an end of the second segment 328 away from the first segment 326. In the illustrated embodiment, the first segment 326 and the sleeve 322 are integrally formed. The heat dissipating cylinder 320 is designed to be the first segment 326 and the second segment 328, which are combinable, so as to benefit for defining the through hole 330 and the bypasses 324, reducing the difficulty of producing, as well as benefit for the assembling of the heat dissipating member 300 and the LED automobile headlamp.

Figure 4:
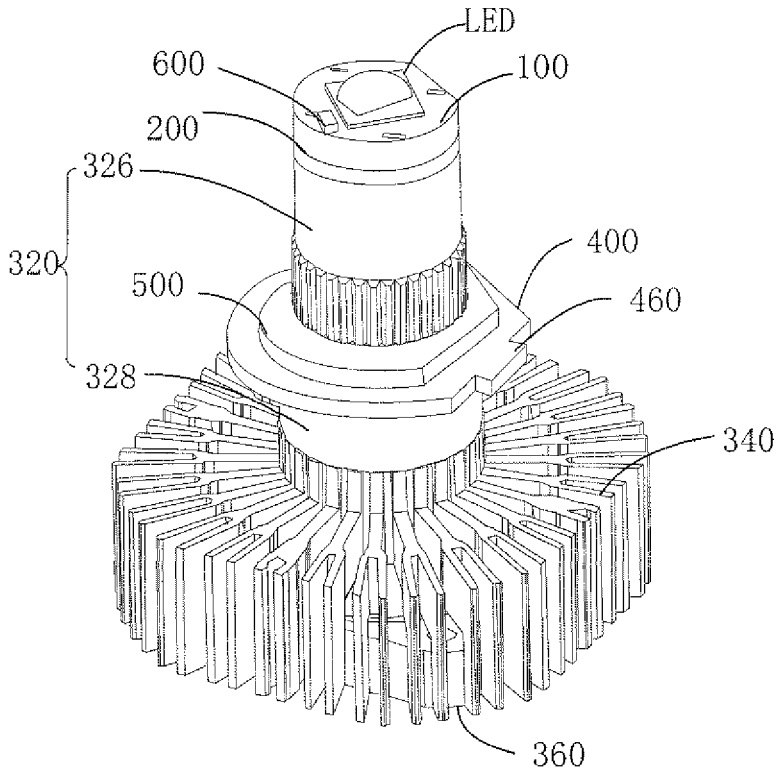
FIG. 4 is a top view of the LED automobile headlamp of FIG. 1.

Referring to FIG. 1, FIG. 3, FIG. 4, FIG. 5, FIG. 6 and FIG. 7, in an preferable embodiment, the LED automobile headlamp further includes a control module (not shown in the drawings) and a temperature sensor 600. The temperature sensor 600 is positioned on the substrate 100 to sense the temperature of the LED lamp. Referring to FIG. 2, FIG. 3 and FIG. 4, the heat dissipating member 300 further includes a fan 360. The fan 360 is adjacent to the heat dissipating fins 340 and opposite to the heat conducting member 200. The control module controls the fan 360 to work in accordance with the temperature, speeding up the heat dissipating of the LED automobile headlamp.

Figure 14:
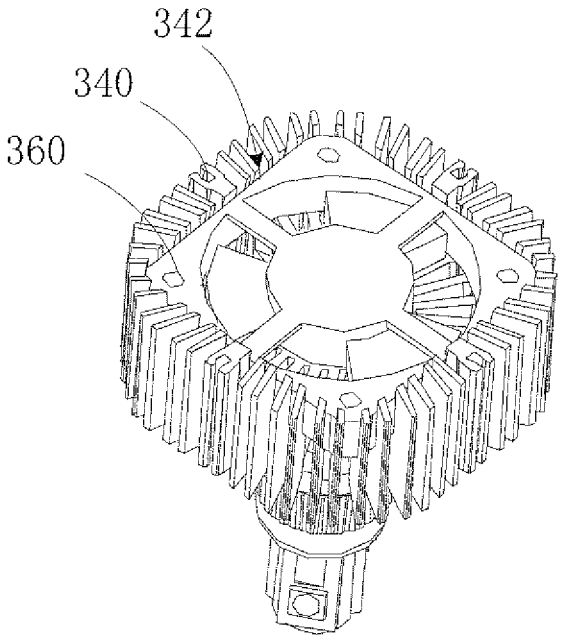
FIG. 14 is a rear view of an LED automobile headlamp in accordance with an embodiment.

Preferably, referring to FIG. 14, the plurality of heat dissipating fins 340 define a receiving groove 342 for receiving the fan 360 on a side coaxial with the heat conducting member 200 and away from the substrate 100. The end of the heat conductive pipe 240 away from the heat conductive platform 220, that is, the end opposite to the fan 260 is designed to be a cone, thereby increasing its contact area with air, and accelerates the heat dissipating. In the illustrated embodiment, a diameter of the fan 360 is greater than that of the heat dissipating cylinder 320, so that it not only accelerates the heat dissipating of the heat dissipating fins 340 and the heat dissipating cylinder 320, but also enables the fan 360 to dissipate the heat of a lamp holder or a lamp bowl of a headlamp assembly after the LED automobile headlamp is assembled to the lamp holder of the automobile headlamp assembly.

Referring to FIG. 1, a retaining member 400 is sleeved on the heat dissipating cylinder 320, and the retaining member 400 is configured to lock the heat dissipating member 300 including the LED lamp to the lamp holder of the automobile headlamp assembly. Understandably, the heat dissipating member 300 In the illustrated embodiment is a main structure of the whole LED automobile headlamp, and fixing the heat dissipating member 300 to the lamp holder of the headlamp assembly means fixing the LED automobile headlamp to the lamp holder of the automobile headlamp assembly. Specifically, with reference to FIG. 2, FIG. 3, FIG. 4, FIG. 5, FIG. 10 and FIG. 11, the retaining member 400 is sleeved on an end of the second segment 328 adjacent to the first segment 326. In an preferable embodiment, an external diameter of the first segment 326 is greater than that of the second segment 328, after sheathing the second segment 328, the retaining member 300 is pressed onto the heat dissipating member 300 by the snapping connection of the first segment 326 and the second segment 328, so as to implement the fixation between the retaining member 400 and the heat dissipating member 300. In other embodiments, an internal diameter of the retaining member 400 is mainly equal to an external diameter of the heat dissipating member 300, the retaining member 400 and the heat dissipating cylinder 320 defines corresponding screw threads, the retaining member 400 and the heat dissipating cylinder 320 are connected to each other via screw threads. The retaining member 400 and the heat dissipating cylinder 320 may also be connected to each other through a screw or a buckle slot.

The retaining member 400 includes a connecting portion 420 having a cylindrical shape and a bayonet 440. The connecting portion 420 is sleeved on the heat dissipating cylinder 320, and the bayonet 400 is radially protrudes from an outer sidewall of the connecting portion 420, and the bayonet 440 is configured to be locked on the lamp holder of the headlamp assembly of a corresponding lamp type. The distance between the bayonet 440 and a luminous point of the LED lamp, that is a luminous focal length of the LED meets the focal distance standard of automobile lamps.

Referring to FIG. 5 and FIG. 9, the connecting portion 420 defines a recess (or a protrusion) 426, while the bayonet 440 defines a protrusion (or a recess) 442, the recess (or protrusion) 426 and the protrusion (or recess) 442 are matched with a corresponding protrusion (or recess) on the lamp holder of the headlamp assembly, which are configured to carry out positioning during the assembling of the LED automobile headlamp.

With reference to FIG. 2, FIG. 3, FIG. 4, FIG. 5, FIG. 6 and FIG. 7, a groove 422 is defined on the connecting portion 420 of the retaining member 400 for receiving a waterproof member 500, and the waterproof member 500 is positioned on one side of the bayonet 440 facing the LED lamp. When the LED automobile headlamp is being assembled in the lamp holder of the headlamp assembly, the retaining member 400 is firstly fixed to the lamp holder of the headlamp assembly, meanwhile, the waterproof member 500 sheathing the groove 422 is pressed between the retaining member 400 and the lamp holder of the headlamp assembly, implementing a sealed waterproofing. Besides, referring to FIG. 5 and FIG. 6, the second segment 328 of the heat dissipating cylinder 320 further defines a concave ring 329 for receiving the waterproof member 500, after the retaining member 400 is fixed to the lamp holder of the headlamp assembly, the heat dissipating member 300 is snapping connected or threadedly connected to the retaining member 400 to implement the complete assembling of the LED automobile headlamp, thus, after the heat dissipating member 300 is butt jointed to the retaining member 400, the waterproof member 500 sheathing the concave ring 329 is pressed between the retaining member 400 and the heat dissipating cylinder 320, implementing a sealed waterproofing. In the illustrated embodiment, the waterproof member 500 is a waterproof rubber ring made of silicone.

With reference to FIG. 10 and FIG. 11, in another embodiment, the retaining member 400 further includes a ring-shaped base seat 460. The base seat 460 is sleeved on the heat dissipating cylinder 320 of the heat dissipating member 300, or fixed to the heat dissipating fins 340 via a screw. A protrusion 426 protrudes outwards from a sidewall of the connecting portion 420 of the retaining member 400, a sidewall of the base seat 460 defines a slot 462 corresponding to the bulge 426, and the heat dissipating member 300 and the retaining member 400 can be positioned and fixed via the bulge 426 and the corresponding slot 462.

Figure 12:
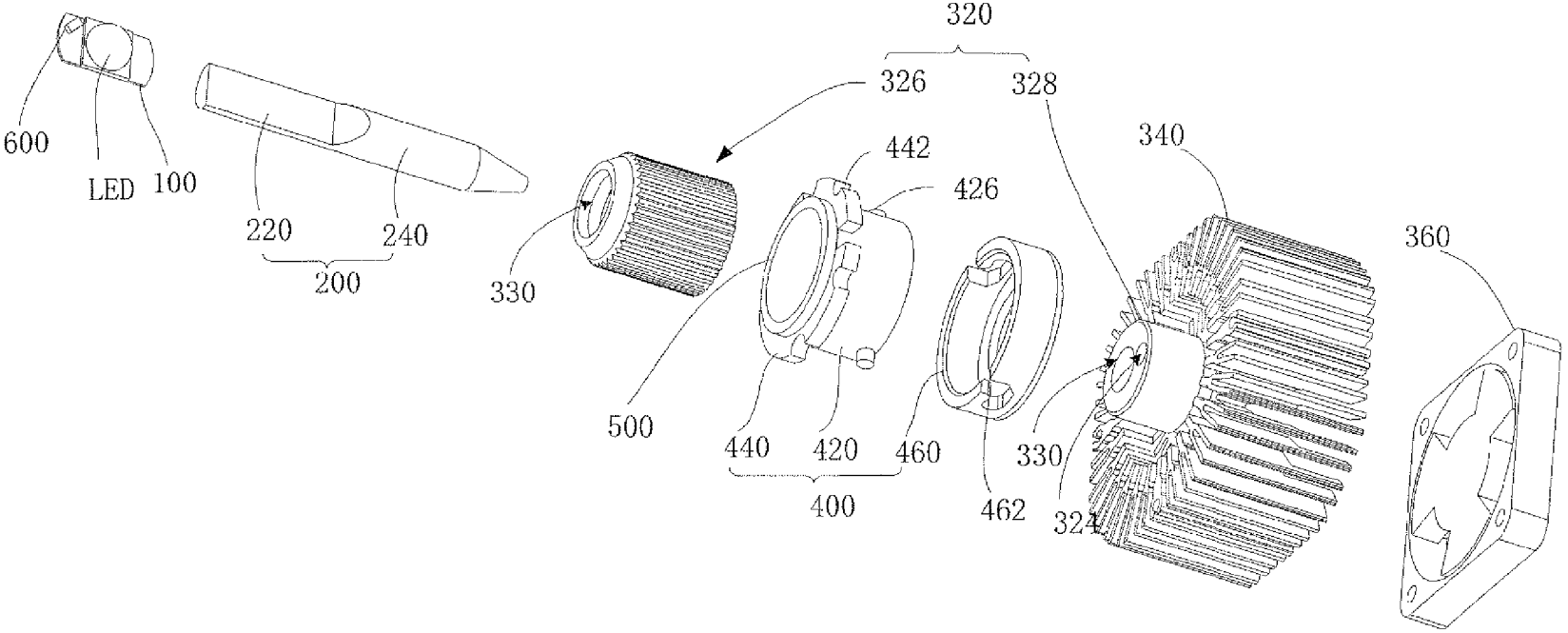
FIG. 12 is an exploded view of an LED automobile headlamp in accordance with another embodiment.
Figure 13:
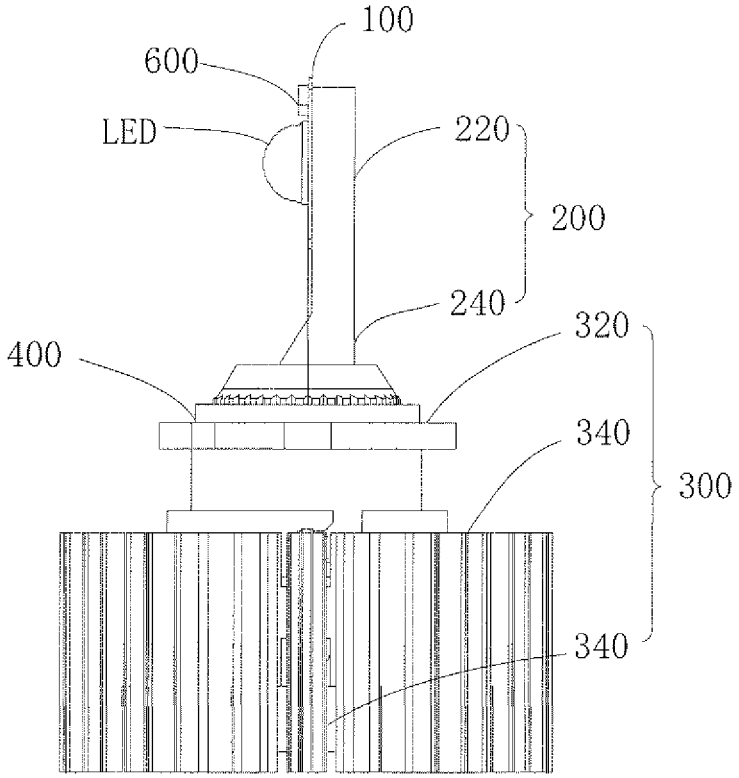
FIG. 13 is a front view of the LED automobile headlamp of FIG. 12.

Referring to FIG. 12, FIG. 12 shows an LED automobile headlamp in accordance with another preferable embodiment, In the illustrated embodiment, by combining with the retaining member 400 shown in FIG. 10, and fixing the substrate 100 to the heat conductive platform 220 having a semi-cylindrical shape, specifically on a tangent plane of the semi-cylinder, the LED lamp on the substrate 100 is radially configured. In other embodiments, two or more LED lamps can be positioned on the tangent plane of the semi-cylinder, increasing the luminance and implementing the high-low lamp function of the LED automobile headlamp.

With reference to FIG. 2, an assemble process of an LED automobile headlamp in accordance with an embodiment is described below.

Firstly, the LED lamp and the temperature sensor 600 are fixed to the substrate 100, the substrate 100 is fixed to the heat conductive platform 220 of the heat conducting member 200, and the heat conductive platform 220 and the heat conductive pipe 240 are butt jointed and fixed to a corresponding position of the first segment 326 of the heat dissipating cylinder 320. Secondly, the retaining member 400 sleeved by the waterproof member 500 is fixed to the bottom of the lamp holder of the headlamp assembly, the wires configured to supply power and transmit control signal go through the bypasses 324 on the heat dissipating cylinder 320 (shown in FIG. 2) and a hole of the retaining member 400, and are connected to the substrate 100 provided with the LED lamp, and then the second segment 328 of the heat dissipating cylinder 320 provided with the heat dissipating fins 340 is fixed to the retaining member 400, and the first segment 326 of the heat dissipating cylinder 320 fixed with the heat conducting member 200 is butt jointed to the second segment 328 of the heat dissipating cylinder 320. Finally, the fan 360 is assembled in the groove 342 of the heat dissipating fins 340, and the wires are connected to the automobile power supply.

The LED automobile headlamp described above applies an LED lamp instead of a tungsten filament lamp bulb or a high intensity discharge applied in the conventional automobile headlamp, so that enhances the luminance and the electro-optical conversion rate of the automobile headlamp, and uses the low-boiling liquid received in the heat conducting member 200 to transmit the heat positioned by the LED lamp to the heat dissipating fins 340 of the heat dissipating member 300, and accelerates the heat dissipating by using the fan 360.

The embodiments described above only show a few implement manners of the present invention, the description is specific and detailed, but it cannot be interpreted as a limitation of the range of the present invention. What should be pointed out is that it is apparent to those skilled in the art that a variety of modifications and changes may be made without departing from the scope of the present invention. Thus, the range of the present invention should be defined by the appended claims.

What is claimed is:

1. An LED automobile headlamp, comprising:

an LED lamp positioned on a substrate, the LED lamp having connected wires;

a heat conducting member having a strip shape, the substrate being fixed to the heat conducting member, and the heat conducting member being internally filled with a low-boiling liquid; and a heat dissipating member comprising a heat dissipating cylinder and a plurality of heat dissipating fins, wherein the heat dissipating cylinder defines a through hole to receive the heat conducting member, and the plurality of heat dissipating fins are fixed to a periphery of an end of the heat dissipating cylinder away from the substrate, the heat dissipation member having bypass pathways outside of the through hole and extending with the through hole, the wires being laid in the bypass pathways;

wherein the heat conducting member occupies substantially the entire center of the through hole in the heat dissipating member;

wherein the bypass pathways of the heat dissipation member provide both a pathway for the wires and an air insulator to limit heat transfer through the sides of the heat conducting member.

2. The LED automobile headlamp according to claim 1, further comprising an retaining member sleeved on the heat dissipating cylinder configured to secure the heat dissipating member provided with the LED lamp to an automobile headlamp assembly.

3. The LED automobile headlamp according to claim 2, wherein the retaining member comprises a connecting portion having a cylindrical shape and a bayonet, the connecting portion is sleeved on the heat dissipating cylinder, and the bayonet radially protrudes from an outer sidewall of the connecting portion, the bayonet is configured to be latched with the automobile headlamp assembly of a corresponding lamp type, and a distance between the bayonet and a luminous point of the LED lamp meets the focal distance of the automobile headlamp assembly.

4. The LED automobile headlamp according to claim 3, wherein the heat conducting member comprises a heat conductive platform and a heat conductive pipe, the substrate is fixed to an end surface or a side surface of an end of the heat conductive platform.

5. An LED automobile headlamp, comprising:

an LED lamp positioned on a substrate;

a heat conducting member having a strip shape, the substrate being fixed to an end of the heat conducting member, and the heat conducting member being internally filled with a low-boiling liquid; and a heat dissipating member comprising a heat dissipating cylinder and a plurality of heat dissipating find, wherein the heat dissipating cylinder defines a through hole to receive the heat conducting member, and the plurality of heat dissipating fins are fixed to a periphery of an end of the heat dissipating cylinder away from the substrate;

a retaining member sleeved on the heat dissipating cylinder configured to secure the heat dissipating member provided with the LED lamp to an automobile headlamp assembly;

wherein the retaining member comprises a connecting portion having a cylindrical shape and a bayonet, the connecting portion is sleeved on the heat dissipating cylinder, and the bayonet radially protrudes from an outer sidewall of the connecting portion, the bayonet is configured to be latched with the automobile headlamp assembly of a corresponding lamp type, and a distance between the bayonet and a luminous point of the LED lamp meets the focal distance of the automobile head lamp assembly;

a waterproof member positioned on the retaining member, wherein the waterproof member is received in a groove defined on the retaining member, and the waterproof member is positioned on a side of the bayonet facing the LED lamp.

6. The LED automobile headlamp according to claim 1, further comprising a control module and a temperature sensor, wherein the temperature sensor is positioned on the substrate and is configured to sense a temperature of the LED lamp; the heat dissipating member further comprises a fan in contact with the plurality of heat dissipating fins and opposite to the heat conducting member; the control module controls the fan to work in accordance with the temperature.

7. The LED automobile headlamp according to claim 6, wherein the plurality of heat dissipating fins define a receiving groove on a side thereof coaxial with the heat conducting member and away from the substrate to receive the fan.

8. The LED automobile headlamp according to claim 1, wherein the heat conducting member is provided with capillaries on an inner sidewall thereof.

9. The LED automobile headlamp according to claim 2, wherein the heat dissipating cylinder comprises a first segment and a second segment sleeved with each other, the retaining member is sleeved on an end of the second segment adjacent to the first segment, and the heat dissipating fins are positioned on an end of the second segment away from the first segment.

10. The LED automobile headlamp according to claim 9, wherein the first segment is threadedly connected to the second segment through a sleeve.

11. The LED automobile headlamp according to claim 1, wherein the heat conducting member has a spike shape with a head at a first end of the spike, a cylindrical body and a pointed end at as second end of the spike.

12. The LED automobile headlamp according to claim 11, wherein the substrate is mounted on the head.

13. The LED automobile headlamp according to claim 1, wherein the heat conducting member has at least one side surface parallel to a central axis of the heat dissipation member, and the LED is mounted on the side surface.

* * * * *